US006103045A

United States Patent [19]

Cirier et al.

[11] Patent Number: 6,103,045

[45] Date of Patent: Aug. 15, 2000

[54] METHOD FOR MAKING THERMOFORMABLE PLASTIC SHEETS OR PLATES FOR USE AS A HEAT-TACKIFIABLE REINFORCING MATERIAL

[75] Inventors: Jean-Pierre Cirier, Versailles; Francoise Stampfer, Nevers; Hubert Poisson, Premery, all of France

[73] Assignee: Lambiotte S.A., Premery, France

[21] Appl. No.: 09/125,688

[22] PCT Filed: Feb. 19, 1997

[86] PCT No.: PCT/FR97/00305

§ 371 Date: Sep. 15, 1998

§ 102(e) Date: Sep. 15, 1998

[87] PCT Pub. No.: WO97/30837

PCT Pub. Date: Aug. 28, 1997

[30] Foreign Application Priority Data

Feb. 23, 1996 [FR] France ..... 96 02263

[51] Int. Cl.[7] ..... A41D 27/00; B32B 31/20

[52] U.S. Cl. ..... 156/244.27; 156/324; 156/309.9; 264/176.1

[58] Field of Search ..... 156/244.11, 244.24, 156/244.27, 324, 309.9; 264/176.1, 177.2, 211.21

[56] References Cited

FOREIGN PATENT DOCUMENTS 2154899 9/1885 United Kingdom .

*Primary Examiner*—Sam Chuan Yao

[57] ABSTRACT

A method for making sheets and/or plates that are thermoformable as of a temperature of 80–90° C. and heat-tackifiable as of 80–90° C., and suitable for use as a heat-tackifiable reinforcing material. According to the method, 30–70 wt % of granules of one or more polymers that have a low melting point (50–90° C.) and are thermoformable as of 80–90° C. are mixed with 70–30 wt % of one or more polymers with a higher melting or softening point, in the form of granules or a powder having a particle size greater than around 500 μm, and preferably of 500–1000 μm, both kinds of polymers being thermoplastic and at least partially compatible, and optionally with the usual additives; the mixture is extruded under low-shear conditions at low temperatures of 100–140° C. to give a mixture having a pasty consistency that is insufficient to form a uniform mixture of molten polymers; and, after extrusion, and optionally once a fabric base (9, 12) has been added to the extruded product, said product is laminated or calendered at a high pressure and at a temperature of around 100° C. to reduce the thickness thereof, then cooled to less than 30° C. before the end of the lamination or calendering process.

6 Claims, 1 Drawing Sheet

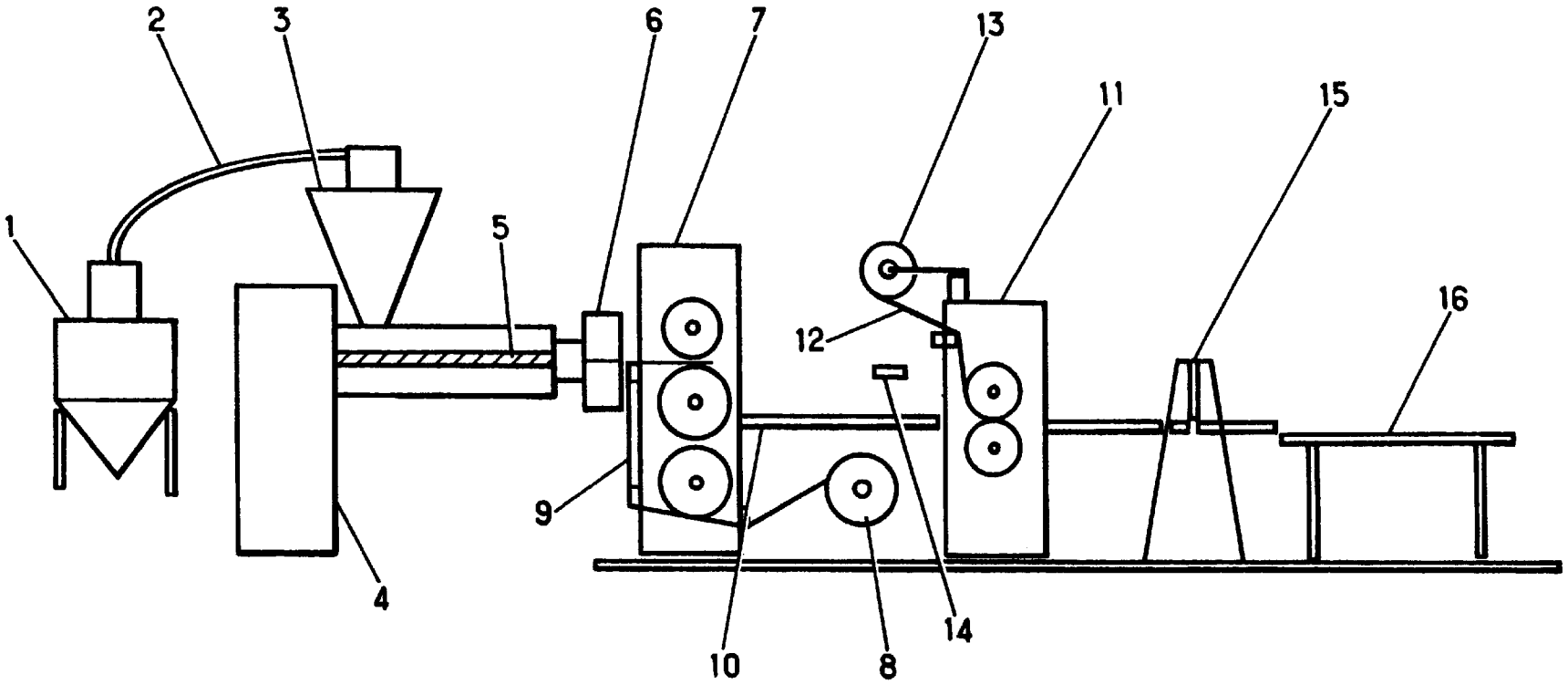
1
2
3
4
5
6
7
8
9
10
11
12
13
14
15
16

METHOD FOR MAKING THERMOFORMABLE PLASTIC SHEETS OR PLATES FOR USE AS A HEAT-TACKIFIABLE REINFORCING MATERIAL

CROSS REFERENCE TO RELATED APPLICATION

This is the 35 USC 371 National Stage of International application PCT/FR97/00305 filed on Feb. 19, 1997, which designated the United States of America.

FIELD OF THE INVENTION

The invention concerns a method of producing sheets or plates of thermoformable plastics material for use as a thermoadhesive reinforcing material or for the preparation of orthopaedic reinforcing pieces.

BACKGROUND OF THE INVENTION

The footwear and leather industry among others requires reinforcing parts which must have a range of characteristics, the main characteristics being as follows:

- they must be thermoformable at low temperature, in particular from 80° C.–90° C., and regain their rigidity fairly rapidly at ambient temperature;
- they must be thermoadhesive at low temperature, in particular from 80° C.–90° C., at a pressure of a few bars and in the space of a few seconds on a variety of backings such as natural or synthetic leathers, thermoplastic materials, natural or synthetic textiles, elastomers, etc.; and
- they must have low sensitivity to creep under normal conditions of use.

French patent FR-A-2 392 810 describes a product of this type constituted by a synthetic material (binder) reinforced with an inert filler material.

European patent EP-A-0 183 912 describes a material of the same type, in which the filler material is entirely or at least superficially constituted by plastics material.

In both cases the starting substances, the binder and the filler material, are constituted by powders with comparable grain sizes preferably of 50 μm to 500 μm, in particular 100 μm to 400 μm. Powders with such grain sizes can cause cost problems in production and handling as well as suffering from the usual problems of powders, namely static electricity and irregularity of the physico-chemical properties of the products obtained.

FR-A-2 559 503 describes stiffening materials for leather, constituted by at least one layer of synthetic material obtained by sintering a mixture of two polymer components with different melting points. The product obtained is not thermoadhesive.

SUMMARY OF THE INVENTION

The invention overcomes the problem by providing sheets and/or plates which are thermoformable from a temperature of 80° C.–90° C. and thermoadhesive from the same temperature, for use as a thermoadhesive reinforcing material, obtained by a method which is characterized in that:

30% to 70% by weight of granules of polymer(s) with a low melting point (of the order of 50° C. to 90° C.) which are thermoformable from a temperature of 80° C.–90° C. are mixed with 70% to 30% by weight of polymer(s) with a higher melting or softening point, in granules or as a powder with a grain size of more than about 500 μm, preferably in the range 500 μm to 1000 μm, the two types of polymer being thermoplastic and completely or partially compatible, and optionally with the usual additives;

- the mixture is extruded under low shear conditions at a low temperature of 100° C. to 140° C. to produce a mixture with a paste-like consistency which is insufficient for the formation of a homogeneous mixture of molten polymers;
- following extrusion and optional addition of a textile backing to the extruded product, the product is rolled or calendered at high pressure at a temperature which is of the order of 100° C. to reduce its thickness, with cooling to a temperature of less than 30° C. before rolling or calendering is completed.

The low melting point polymer can be a polyester, polyurethane, ethylene/acetate copolymer or ethylene/acrylic monomer copolymer with a melting point of 50° C. to 90° C. These polymers are in the form of grains of about 2 mm to 3 mm, such as those which are commercially available. Other polymers can also be used, provided that they have adhesive properties at low temperatures. and at low pressures.

Examples of higher melting or softening point polymers are polyvinyl chlorides, polycarbonates, polyethylenes, ABS (acrylonitrile/butadiene/styrene) or any other polymer which is completely or partially compatible with the low melting point polymers cited above, in the form of grains such as those which are commercially available (2 mm to 3 mm granules), or in the form of powders which preferably have a grain size of 500 μm to 1000 μm. Such powders can be obtained during plastics material recovery treatment.

The use of such grain sizes results in an effective mixture of the two types of polymer which is easy to extrude. The powders used in the prior art technique mentioned above are more difficult to handle and are generally not suitable for extrusion.

The optional additives are the usual additives for this type of product, for example inorganic fillers of small grain sizes, plasticizers, colorants, etc. In general, up to 20 parts by weight of these usual additives are used per 100 parts by weight of polymer mixture.

The mixture obtained is heated to a temperature of 100° C. to 140° C. in a short single- or double-screw extruder with a low compression and/or shear ratio. This type of extruder avoids too much shear on the polymers during melting or softening; in this way and with the heat, the mixture takes on a paste-like consistency which is insufficient to transform the effective mixture of granules into a homogeneous mixture of molten polymers. This prevents complete interpenetration of the polymer networks on melting. Extrusion is carried out at low loads and at a temperature which does not exceed 140° C., corresponding to imperfect extrusion conditions. A product is thus obtained which retains the adhesive properties of the low melting point type-of polymer and acquires the thermoforming and rigidity properties of the mixture of the two polymer types associated in a partial alloy.

The surface of the product obtained is irregular (rough) and loosely bonded; grains of the high melting or softening point type of polymer are clearly visible, indicating that the starting granules did not melt completely.

The strip obtained is then calendered or rolled with or without a textile backing. When calendering, a three roll calender is used, the product being calendered between two rolls at high pressure and at a temperature of about 100° C. to reduce its thickness and then being cooled over the third roll to a temperature of less than 30° C. Rolling can be performed out instead of calendering, using a belt press with a heating zone and a cooling zone to allow the product to be hot rolled, and to cool the resulting rolled strip.

The calendering or rolling operation produces the desired thickness of the final product since the imperfect extrusion conditions can produce a continuous strip only if it is relatively thick, of the order of 1 mm to 3 mm thick, since finer dies do not pass the paste-like mixture. The high-pressure calendering or rolling operation reduces the thickness. The product from this treatment is densified and its bonding is good, it has a smooth surface and a good surface adhesive power: the result of the operation appears to make the more fluid substance, namely the low melting point polymer, migrate to the surface. The product obtained can then undergo conventional operations such as the calender laminating with cloth or some other textile backing, reel winding or cutting into sheets or plates.

BRIEF DESCRIPTION OF THE DRAWINGS

The invention is described in more detail below with reference to the FIGURE which illustrates an implementation of the method.

DETAILED DESCRIPTION OF THE INVENTION

The starting materials for mixing, namely the low melting point polymer, the higher melting point polymer and the usual additives, are introduced into a metering mixer 1, for example a multi-chamber weight metering mixer. The mixture obtained is transported via a conduit 2 to a feed hopper 3 of an extruder 4. The extruder has a relatively short screw 5 which expels the paste-like mixture via a die 6. The film leaving the die 6, which film is rough, loosely bonded together, and has a thickness of 1.2 mm for example, is fed to calender 7, for example a three-roll calender, into which a first textile backing 9 is introduced from a supply roll 8. The product leaving calender 7 is smooth, densified and well bonded together, and has a thickness of 1.0 mm±0.05 mm, for example. It is transported by a conveyor belt to a second calender 11 operating at low pressure supplied with a second textile backing 12 from a feed reel 13. Before entering calender 11, the surface of the transported product is re-heated to a temperature of 80° C.–100° C., for example using an infra-red apparatus 14.

The product obtained from calender 11 is cut at a cutting station 15 and packed on a packing table 16.

Clearly, the use of the second calender 11 is optional and it may be sufficient to use a single textile backing for the product, or even not to use any textile backing. The first textile backing can be introduced as described above before high pressure calendering, or it can be introduced after the first calendering, with the second textile backing.

Similarly, the cutting station and packing table can be replaced by a spool winding apparatus.

The first calender 7 can also be replaced by a belt press as described above. In such a press, the inserted substance is highly compressed and the thickness of the product which leaves the extruder is substantially reduced, as in the case of calendering.

The term polymer(s) means either a polymer or a mixture of polymers, in both cases optionally with conventional additives, in particular formulations which are commercially available.

What is claimed is:

1. A method of producing sheets and/or plates which are thermoformable from a temperature of 80° C.–90° C. and thermoadhesive from a temperature of 80° C.–90° C., for use as a thermoadhesive reinforcing material, the method comprising:

mixing a) a first component comprising 30% to 70% by weight of granules of one of a first polymer or a first mixture of polymers having a low melting point ranging from 50° C. to 90° C., which are thermoformable from a temperature of 80° C.–90° C., with b) a second component comprising 70% to 30% by weight of one of a second polymer or a second mixture of polymers having a higher melting or softening point, in granules or powder having a grain size of more than about 500 μm, the two components being thermoplastic and completely or partially compatible, and optionally with c) additives selected from the group consisting of inorganic fillers, plasticizers and colorants to obtain a third mixture;

extruding the third mixture under low shear conditions at a low temperature ranging from 100° C. to 140° C. to produce a product having a rough and loosely bonded surface, said product having a pasty consistency which is insufficient to form a homogeneous mixture of molten polymers, thereby preventing complete interpenetration of polymer networks on melting; and following extrusion and optional addition of a textile backing to the extruded product, rolling or calendering the product at high pressure at a temperature of about 100° C. to reduce the thickness, with cooling to a temperature of less than 30° C. before rolling or calendering is completed.

2. The method according to claim 1, wherein the grain size ranges between 500 μm to 1000 μm.

3. The method according to claim 1, further comprising laminating another textile backing to the product obtained by passage through a calender.

4. The method according to claim 1, wherein the product obtained is spool wound or cut into sheets.

5. The method according to claim 1, wherein the low melting point first polymer or first mixture of polymers is selected from the group consisting of polyesters, polyurethanes, ethylene/acetate copolymers and ethylene/acrylic monomer copolymers.

6. The method according to claim 1, wherein the higher melting or softening point second polymer or second mixture of polymers is selected from the group consisting of polyvinyl chloride polymers, polycarbonates, polyethylenes and acrylonitrile/butadiene/styrene copolymers.

* * * * *